US007038632B2

(12) United States Patent
Webb et al.

(10) Patent No.: US 7,038,632 B2
(45) Date of Patent: May 2, 2006

(54) CO-LOCATED MULTI-BAND ANTENNA

(75) Inventors: David Webb, Dallas, TX (US); David Geen, Peebles (GB); Ronald Brandau, Orland Park, FL (US)

(73) Assignee: Andrew Corporation, Westchester, IL (US)

( * ) Notice: Subject to any disclaimer, the term of this patent is extended or adjusted under 35 U.S.C. 154(b) by 0 days.

(21) Appl. No.: 10/904,674

(22) Filed: Nov. 22, 2004

(65) Prior Publication Data

US 2005/0110694 A1 May 26, 2005

Related U.S. Application Data

(63) Continuation-in-part of application No. 10/484,572, filed as application No. PCT/US02/28991 on Sep. 12, 2002, now Pat. No. 6,980,170.

(60) Provisional application No. 60/601,396, filed on Aug. 13, 2004, provisional application No. 60/322,343, filed on Sep. 14, 2001.

(51) Int. Cl.
*H01Q 13/00* (2006.01)

(52) U.S. Cl. ..... 343/781 P; 343/781 CA

(58) Field of Classification Search ..... 343/781 P, 343/781 CA

See application file for complete search history.

(56) References Cited

U.S. PATENT DOCUMENTS 3,281,850 A 10/1966 Hannan
3,438,041 A 4/1969 Holtum
3,500,419 A 3/1970 Leitner et al.
3,710,341 A 1/1973 Sciambi
3,927,408 A 12/1975 Schmidt
4,034,378 A 7/1977 Ohm
4,298,876 A * 11/1981 Crochet ..... 343/756
4,647,938 A 3/1987 Roederer et al.
4,792,813 A * 12/1988 Rosen ..... 343/781 P
5,546,097 A 8/1996 Ramanujam et al.
5,557,292 A 9/1996 Nygren et al.

(Continued)

FOREIGN PATENT DOCUMENTS

GB 2031655 4/1980

*Primary Examiner*—Tan Ho
(74) *Attorney, Agent, or Firm*—Babcock IP, LLC

(57) ABSTRACT

A multi-band reflector antenna having a main reflector, a sub reflector, a first feed and a second feed. The first feed, the sub reflector and the main reflector positioned in a Gregorian optic configuration wherein an output of the first feed is directed to the sub reflector, from the sub reflector to the main reflector and from the main reflector into a first beam. The sub reflector may be shaped to distribute the output of the first feed reflecting off the sub reflector onto the main reflector whereby a central area of the main reflector has a lower illumination than a surrounding outer area of the main reflector and or elongated vertically. The second feed projecting from a hole in the sub reflector is oriented whereby an output of the second feed is directed to the main reflector and from the main reflector into a second beam.

41 Claims, 12 Drawing Sheets

U.S. PATENT DOCUMENTS

| | | | | |
|---|---|---|---|---|
| 5,576,721 | A | 11/1996 | Hwang et al. | |
| 5,805,116 | A | 9/1998 | Morley | |
| 5,859,619 | A | 1/1999 | Wu et al. | |
| 6,049,312 | A | 4/2000 | Lord et al. | |
| 6,137,451 | A | 10/2000 | Durvasula et al. | |
| 6,211,834 | B1 | 4/2001 | Durham et al. | |
| 6,225,961 | B1 | 5/2001 | Benjauthrit | |
| 6,239,763 | B1 | 5/2001 | Cuchanski | |
| 6,243,048 | B1 * | 6/2001 | Luh | 343/781 P |
| 6,320,553 | B1 | 11/2001 | Ergene | |
| 6,414,646 | B1 * | 7/2002 | Luh | 343/781 CA |
| 6,512,485 | B1 | 1/2003 | Luly et al. | |
| 6,545,645 | B1 * | 4/2003 | Wu | 343/781 P |
| 6,664,933 | B1 | 12/2003 | Spirtus | |
| 6,774,861 | B1 * | 8/2004 | Choung et al. | 343/781 CA |
| 2003/0234745 | A1 | 12/2003 | Choung et al. | |

* cited by examiner

CO-LOCATED MULTI-BAND ANTENNA

CROSS REFERENCE TO RELATED APPLICATIONS

This application is a continuation-in-part of U.S. Utility application Ser. No. 10/484,572 filed on Aug. 22, 2004 entitled "Co-Located Antenna Design", now U.S. Pat. No. 6,980,170, which is the National Stage of International Application PCT/US02/28991 filed on Sep. 12, 2002, entitled "Co-Located Antenna Design" which was published in English as International Publication Number WO 03/026173 A1 on Mar. 27, 2003; This application claims the benefit of U.S. Provisional Patent Application Ser. No. 60/322,343 filed on Sep. 14, 2001, entitled "Multi Beam CoLocated Antenna". Also, This application claims the benefit of U.S. Provisional Patent Application Ser. No. 60/601,396 filed on Aug. 13, 2004, entitled "CoLocated MultiBand Antenna". U.S. Provisional patent application Ser. Nos. 60/322,343, 60/601,396 and International Application PCT/US02/28991 are each incorporated herein by reference in their entirety.

FIELD OF THE INVENTION

The field of the invention relates to communication systems and more particularly to multi-band antennas useful, for example, for satellite communication.

BACKGROUND OF THE INVENTION

Satellite communication systems are known and generally well understood. Such systems are typically used in telephone, television and data communications over long distances.

Satellite communication systems are typically used in conjunction with one or more ground stations. Ground stations are usually constructed as high value subsystems able to combine and disperse communication signals routed through the satellite.

Because of the volume of signal traffic typically processed by ground stations, signal traffic may be divided among relatively large numbers of carrier signals. Relatively large dish antenna are often provided to transceive those signals with a desired satellite(s).

Recently, special purpose systems have been developed for transceiving signals with satellites. One example of such a system is the Very Small Aperture Terminal (VSAT) used for the communication of data, voice and video signals, except terrestrial broadcast television.

A VSAT may include a transceiver and antenna (placed outdoors in direct line of sight with the satellite) and an interface unit. The interface unit is typically placed indoors and functions to interface the transceiver with end-user equipment.

One application of VSAT is an Internet/Satellite TV system that provides combined satellite TV and Internet services. The Internet/Satellite TV system interacts with two co-located or close-located satellites. A first satellite may provide two-way Internet access. Internet messages may be received in the 20 GHz band and transmitted on the 30 GHz band.

The second co-located or close-located satellite may provide satellite TV. The second satellite may transmit satellite TV in the 12 GHz band. To provide an extended range of satellite TV channels, multiple satellites may be used. Depending upon position, multiple satellites may be targeted with a nominally coincident beam and or one or more scanned beams.

While the Internet/satellite TV system works well, the three different carriers of 12, 20 and 30 GHz are typically transceived through a dual band antenna and a second, separate antenna for the third band or in a single tri-band antenna using frequency selective surface (FSS) techniques. The use of dual antennas or FSS techniques is expensive and or aesthetically unacceptable in a consumer environment. Further, FSS surfaces may be susceptible to environmental degradation and or fouling.

Competition in the consumer VSAT market has focused attention on minimization of overall costs, improved reliability and ease of installation/use. Accordingly, a need exists for a multi-band antenna system that is cost efficient, compact and conveniently mountable to an exterior of an end-user's home.

Similar efficiencies are also desirable for multi-band terrestrial microwave antenna systems with nominally coincident beams and or one or more scanned beams.

Therefore, it is an object of the invention to provide a co-located multi-band antenna that overcomes deficiencies in the prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
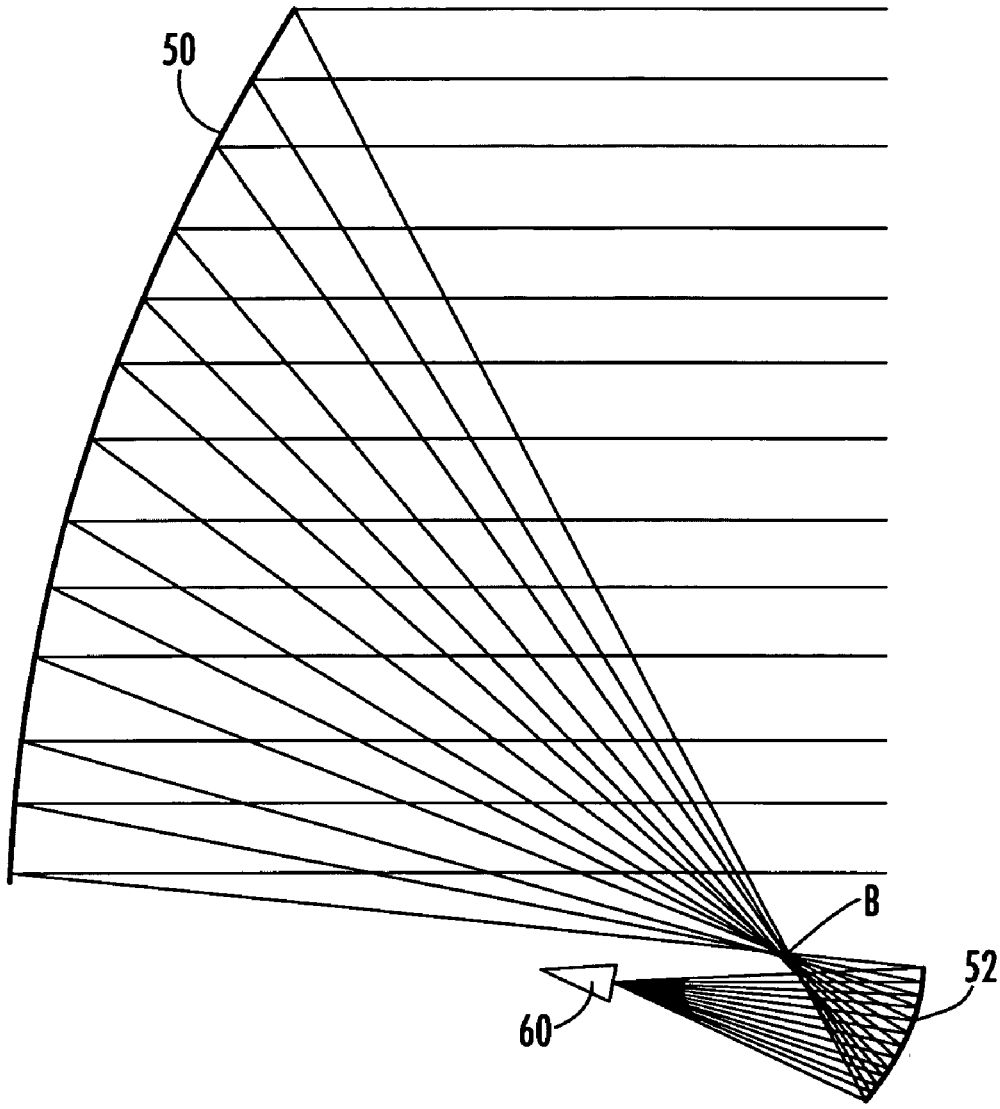
FIG. 1 (PRIOR ART)
FIG. 1 is a side schematic ray diagram for a prior art Gregorian dual offset reflector antenna.
Figure 2:
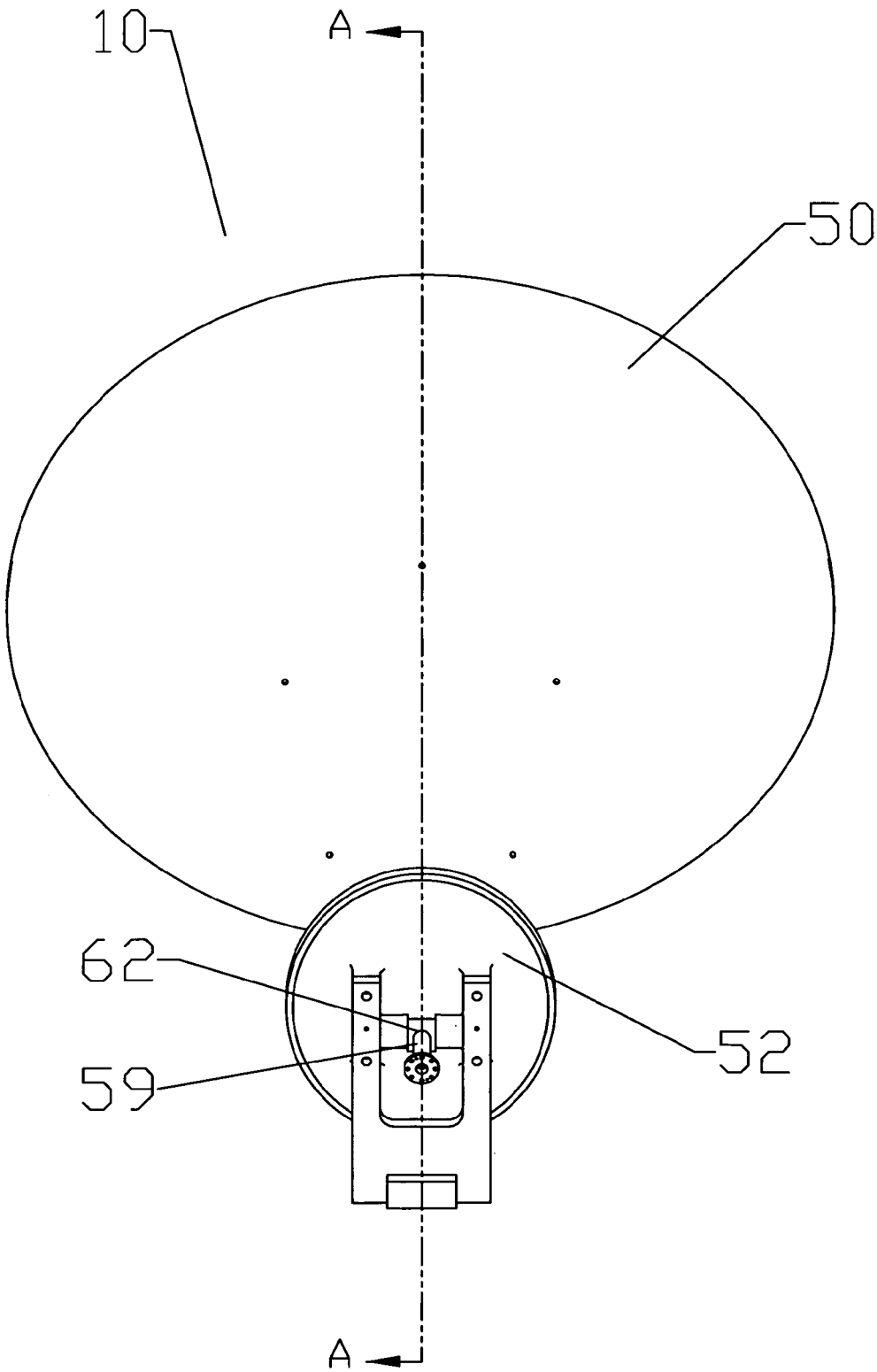
FIG. 2 is an elevated isometric front view of an exemplary embodiment of an antenna according to the invention.
Figure 3:
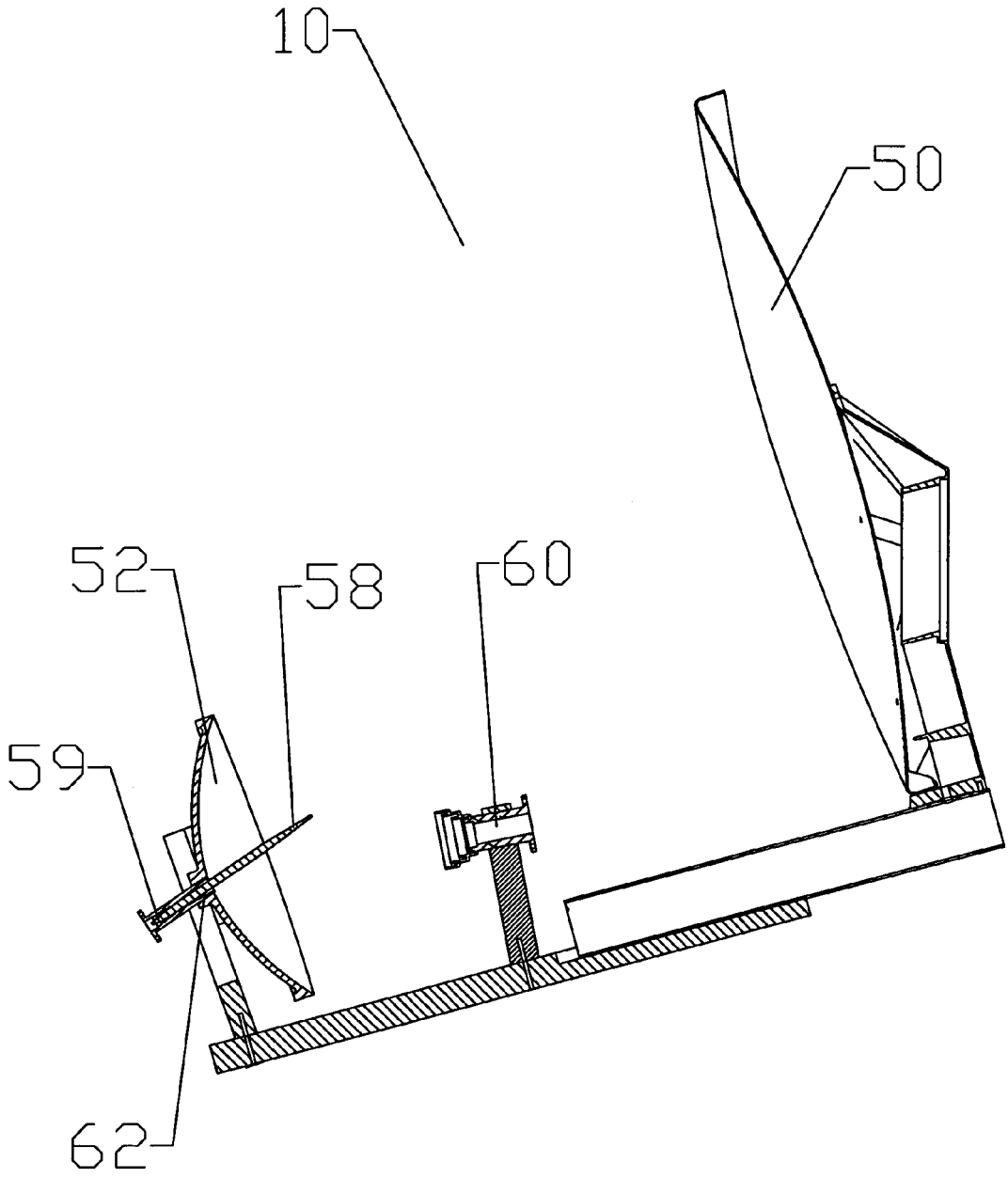
FIG. 3 is a cut-away side view of the antenna, along line A—A of FIG. 2.
Figure 4:
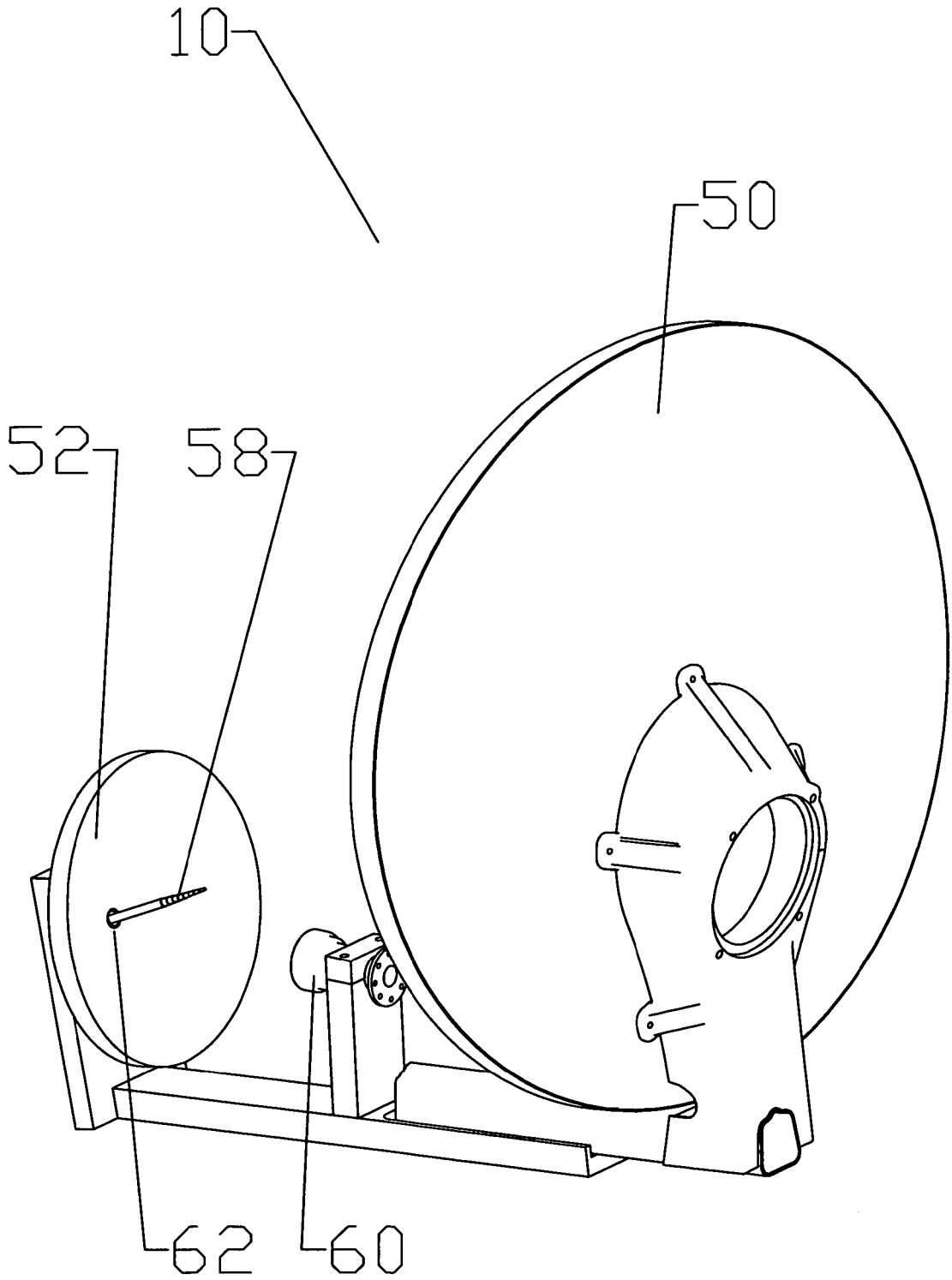
FIG. 4 is an angled isometric rear view of the antenna of FIG. 2.

In a conventional, non-shaped Gregorian system, as shown for example in FIG. 1, the main reflector 50 is a section of a paraboloidal surface and the sub reflector 52 is a section of an ellipsoidal surface. Ray-optic analysis shows rays launched by the first feed 60 strike the sub reflector 52 to be reflected so as to pass through a single point, the focal point of the main reflector, before striking the main reflector 50 and reflecting again to form the main beam. The first feed 60 is ideally positioned at one focus of the ellipsoid-section sub reflector 52, with the sub reflector 52 positioned so that the other focus of the ellipsoid is coincident with the focal point of the main reflector 50. By stating that the main reflector 50, sub reflector 52, and first feed 60 collectively form an antenna 10 system with Gregorian optics, it is understood by those skilled in the art that these components are arranged so that the focal point or focal region of the main reflector 50 is located in front of the sub reflector 52, i.e. on the same side of the sub reflector 52 as the first feed 60.

The familiar offset configuration shown is the preferred configuration of the present invention. Axisymmetric configurations of the present invention may also be applied. However, blockage of the main reflector 50 by the sub reflector 52 and first feed 60 is reduced by the offset configuration.

Applicants research has demonstrated that one difficulty with the conventional system is that for a small-aperture main reflector 50, the corresponding ellipsoid-section sub reflector 52 is typically too small to function as a proper sub reflector 52. For example, a 74×59 cm main reflector 50 requires a non-shaped sub reflector 52 approximately 4 wavelengths in size at 12 GHz for the geometrical parameters selected. This requires a relatively large and expensive, high-gain first feed 60 to illuminate the sub reflector 52 if excessive feed spillover is to be avoided. Such a sub reflector 52 is also too small electrically for the theory of Geometrical Optics (GO) to hold, on which the ray-tracing analysis depends. In this case, even with a high-gain first feed, there is considerable loss in gain due to undesired scattering by the sub reflector 52 in directions other than the main reflector 50.

One skilled in the art will appreciate that configuration of an antenna involves trade-offs of component cost, electrical performance and overall antenna size. While reception bands may be degraded in the compromise chosen, broadcast bands are typically required to at least meet, for example, applicable regulatory agency earth station transmission specifications.

The problems of the conventional configuration are reduced by the present invention, for example as demonstrated by FIGS. 2–5, through use of a GO shaping routine, whereby the sub reflector 52 size is increased to capture energy from the first feed 60 and redirect it to the main reflector 50 with minimum spill over. This allows use of a relatively inexpensive conventional first feed 60 with only moderate gain. For example, in embodiments where there is −12 dB illumination at the sub reflector 52 rim from a 14 dBi first feed, a sub reflector 52 roughly 9 wavelengths in size may be used. This is large enough electrically for ray-optic analysis to remain valid so that the main reflector 50 is illuminated as designed and excessive feed spillover is avoided. Alternatively, shaping methods other than GO can be used to similar effect in the present invention, for example surface optimization via Physical Optics (PO) analysis.

However, while the GO sub reflector 52 shaping procedure fixes one problem another is created. As the sub reflector 52 is increased in size, and perturbed from the conventional section of an ellipsoidal surface, rays launched from the first feed 60 and reflected from the sub reflector 52 surface no longer pass exactly through the focal point of the main reflector 50. Instead, they pass near the main reflector 50 focal point through a broader focal region B (see FIG. 5) on their way to illuminating the main reflector 50. This creates a roughly quadratic phase error across the main reflector 50 aperture. The more significantly perturbed the shaped sub reflector 52 surface is from the ideal ellipsoid-section surface the greater the phase error. That is, the larger the sub reflector 52 becomes, the more phase error is introduced as the rays pass farther away from the main reflector 50 focal point.

The shaping-induced phase error related to the increased size of the sub reflector 52 can be either minimized or corrected for in at least three ways according to the present invention. First, the main reflector 50 can be shaped as well, perturbed from a section of a paraboloidal surface, to compensate for the phase error. This is a possible embodiment of the present invention, but not preferred because to achieve multi-band capability the main reflector 50 aperture is shared between the beam produced by the first feed 60 illuminating the sub reflector 52 and an additional alternative frequency band beam or beams produced by direct illumination of the main reflector 50 by a second feed 58 and, if desired, other additional feeds. Therefore, if shaping of the main reflector 50 is applied, it is preferred that only minimal shaping is used so as to not unacceptably degrade performance of the second feed(s) 58, or the second feed(s) 58 themselves are also adapted to compensate for the main reflector shaping.

A shaped main reflector 50 will not have a single focal point, but rather a distributed "focal region" roughly in the same position as the focal point of a best-fit paraboloidal surface, also positioned in front of the sub reflector 52. In a parabolic main reflector 50, the focal region will be a single focal point positioned in front of the sub reflector 52 as found in conventional Gregorian reflector systems. Similarly, the term "focal region" is also used herein with respect to the region near the focal point of a paraboloidal main reflector 50 through which rays from a shaped sub reflector 52 pass, as shown for example in FIG. 5.

In a second method of phase error reduction the sub reflector 52 may be shaped. Using a sub reflector 52 roughly 9 wavelengths in size, the shaping-induced phase error may be minimized by leaving a "hole" or minima proximate the center of the main aperture illumination, as shown for example in the FIG. 5 ray-tracing diagram. For clarity, the ray diagram demonstrates only the signal path with respect to the first feed 58. By shaping the sub reflector 52 to direct most of the illuminating energy to the outer regions of the main reflector 50, there is less variation in phase across the main reflector and the aperture efficiency is improved. This is apparent from an equal-path length analysis of rays striking the main reflector center, the main reflector 50 rim, and a point midway between the center and rim: there is less path-length difference between the last two rays than there is between the first two rays.

Alternatively, the configuration tradeoff may be applied in a third form of phase error minimization by using a higher-gain first feed 60, for example 17 dBi, and a smaller sub reflector 52 such as 6 to 7 wavelengths in size. This sub reflector 52 is just large enough to work electrically, yet is closer to the ideal ellipsoid-section shape so that phase error is minimized. In such embodiments, a more uniform amplitude illumination is preferred to get maximum aperture efficiency, so sub reflector 52 shaping is applied which does not form a minima in the main aperture central illumination. This has the additional advantage of reducing sidelobes in the beam produced by the first feed 60.

Returning to FIGS. 2–5, multi-band capabilities are added to the antenna 10 via a second feed 58. A hole 62 formed in a generally central region of the sub reflector 52 locates the second feed 58 (e.g., a horn, waveguide, helical antenna, dielectric rod, etc.) oriented with a predominant axis of radiation aligned to illuminate the main reflector 50. It should be understood that, as used herein, the term "feed" means a structure that is inherently capable of transmitting and/or receiving radio frequency energy. It should also be understood that while the second feed 58 is disposed within the sub reflector 52, the phrase "disposed within" is also meant to include the situation where the end of the radiator extends towards the main reflector 50 beyond the reflecting surface of the sub reflector 52, is flush with the sub reflector 52 or is recessed into the hole 62 of the sub reflector 52. Preferably, the second feed 58 is a dielectric polyrod antenna projecting through the hole 62, extending from and supported by a waveguide launch 59, oriented along or close to the axis of a center reflected ray of the main reflector 50.

Where the second feed 58 is a dielectric polyrod antenna, the exact phase center of the dielectric polyrod antenna, as will be appreciated by those skilled in the art, is located some distance back from the tapered radiating end of the polyrod along the axis of the polyrod. This distance is generally a function of frequency. Typically in wideband or multi-band operation (in this embodiment, 20/30 GHz operation), some position along the polyrod is identified as a "best compromise" approximate phase center over the frequency band or bands of operation. This compromise position along the polyrod would normally be aligned with the focal point of the main reflector 50 or placed somewhere in the main reflector 50 focal region if a shaped main reflector 50 is used for optimal focusing of the beam or beams generated by the first feed 58.

Figure 5:
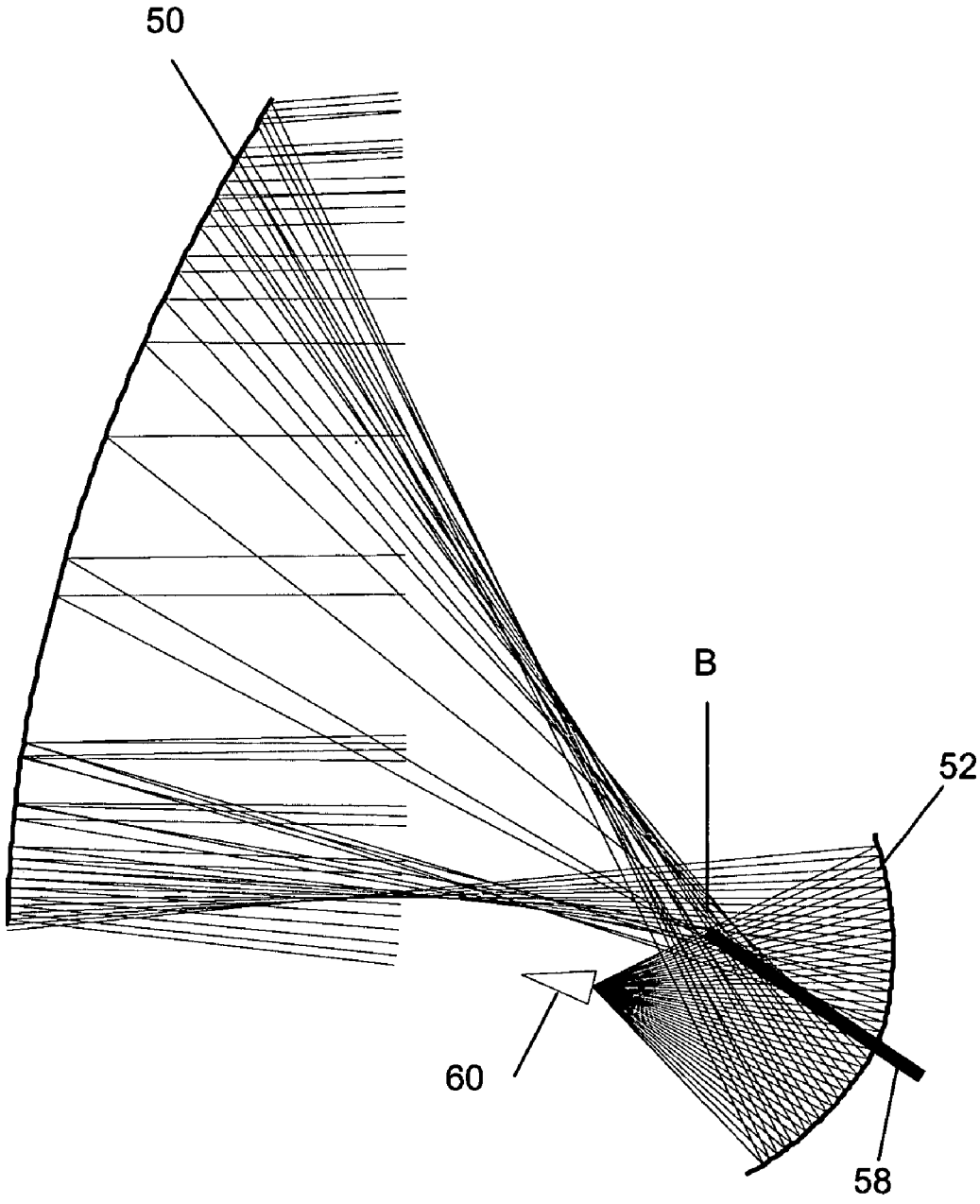
FIG. 5 is a side view of a schematic ray diagram for the antenna of FIG. 2.
Figures 6A, 6B, 6C:
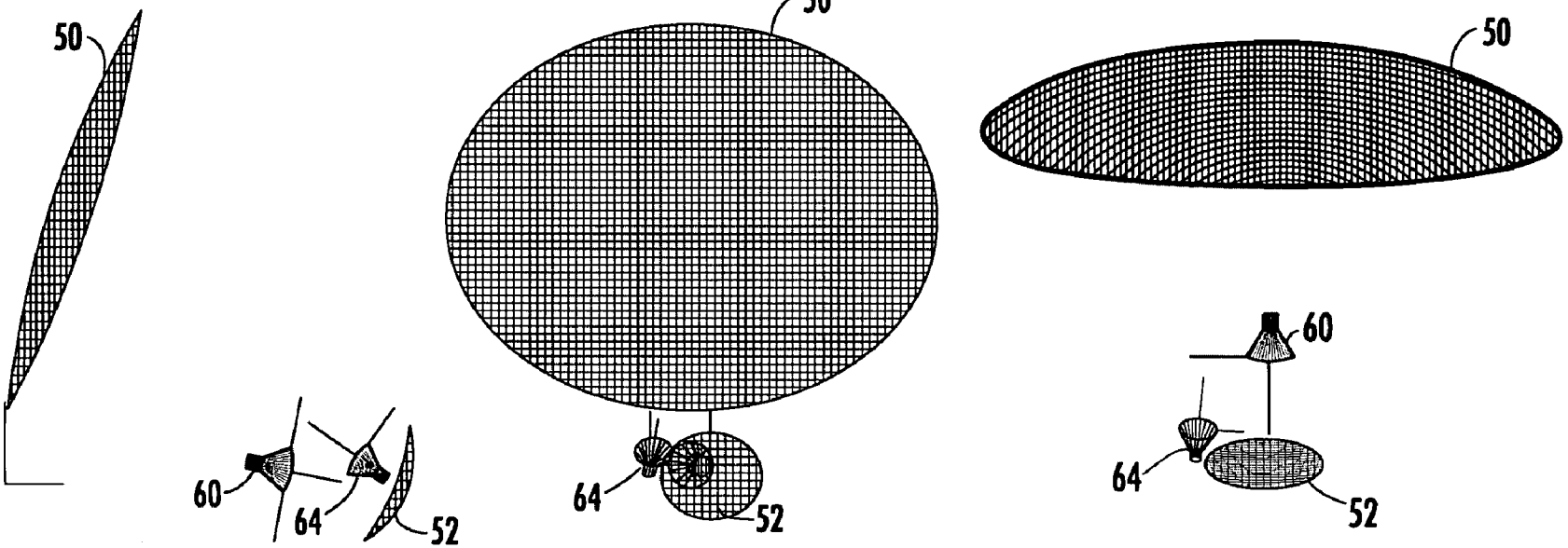
FIG. 6*a* is a schematic side view of an antenna according to the invention with a scanned-beam feed.
FIG. 6*b* is a front view of FIG. 6*a*.
FIG. 6*c* is a top view of FIG. 6*a*.

Even if shaping is applied to the sub reflector 52 to leave a "hole" or minima proximate the center of the main aperture illumination, as indicated in FIG. 5, the second feed 58 interferes with a significant number of the incident and reflected rays of the sub reflector 52 corresponding to the first feed 60. The interfering effect is greatest with respect to rays scattered from the forward tip of the second feed 58. Therefore, minimizing the entry of the second feed 58 into the focal region B by positioning it closer to the sub reflector 52, locating the phase center closer to the forward tip of the second feed 58 and or minimizing the overall width of the second feed 58 improves electrical performance of the first feed in a trade-off with performance of the second feed 58.

The sidelobes impacting Carrier/Interference (C/I) are also increased by the shaping of the sub reflector 52 for an amplitude distribution with a center minima. For a 74×59 cm main reflector, the GO shaping procedure stretches the sub reflector 52 to about 9 wavelengths in diameter. This makes the sub reflector 42 electrically large enough, but introduces a phase error that generally cannot be corrected in the main reflector 50 because of the shared aperture with the second feed 58. If C/I is a priority, alternate embodiments which do not have the center minima may be used.

In such embodiments, as described above, the required size of the sub reflector 52 may be reduced in size to about six wavelengths by using a higher gain first feed 60, for example 17 dBi. As the first feed 60 gain is increased, the associated feed angle decreases. For example, a 17 dBi first feed 60 may have a feed angle of 26 degrees. With a smaller sub reflector 52, the phase errors induced by using a GO-shaped, larger sub reflector 52 instead of a canonical ellipsoid sub reflector 52 are minimized. Therefore, it may not be necessary to apply the sub reflector 52 shaping to generate a center minima, further improving sidelobes and C/I.

In further embodiments the size of the main reflector 50 and or first feed 60 may be increased to improve electrical performance. However, maintaining a minimal overall antenna 10 size is often a priority for consumer embodiments.

Any beam or beams radiated by the second feed 58, for example two beams in the 20 and 30 GHz bands, and a beam or beams radiated by the first feed 60, for example a single beam in the 12 GHz band, are typically nominally coincident in the present invention. By "nominally coincident", it is implied that all beams point in the same direction, or very nearly so. This includes the case where all beams communicate, for example, with transponders located on a single satellite, in which case the beams would point in as close to the same direction as possible. It also includes the case where one or more of the beams points in a slightly different direction, possibly to communicate, for example, with one or more satellites in very close proximity along the geostationary arc, for example less than 5°, away from the satellite or satellites in communication with the other nominally coincident beam or beams. By "very nearly" in the same direction, it is implied in satellite applications that nominally coincident beams point in directions closer than typical satellite spacings of, for example, 5° or 9° along the geostationary arc. In the present invention, "scanned beams" are those pointing away from the nominally coincident beams at angles of 5° or more away along the geostationary arc in satellite applications.

For terrestrial microwave applications, the distinction between "nominally coincident" and "scanned" beams is similar, in that nominally coincident beams point in approximately the same direction to within a small angle defined for terrestrial applications such as a single tower or adjacent towers and scanned beams apply a larger angle such as between spaced apart towers.

It may also be desirable to add fourth beam functionality to the antenna, where the fourth beam is scanned away from the three co-located main beams the antenna is ordinarily adapted for. This fourth beam may point to another satellite separated at some distance along the geostationary arc from the satellite(s) communicating with the VSAT via the three co-located beams. This separation could be, for example, 5° or 9° along the geostationary arc, with the desired fourth beam scanned roughly 5.5 or 9.9°, respectively, in the azimuth plane of the antenna. The fourth beam may be provided by the addition of an additional third feed 64 located next to the sub reflector 52, as shown in FIGS. 6–8 and 10. The third feed 64 may be configured to illuminate the main reflector 50 in a standard single-offset reflector configuration. With the Gregorian optics used, rays clearing the third feed 64 are reflected away from it to illuminate the opposite side of the main reflector 50.

Figure 7C:
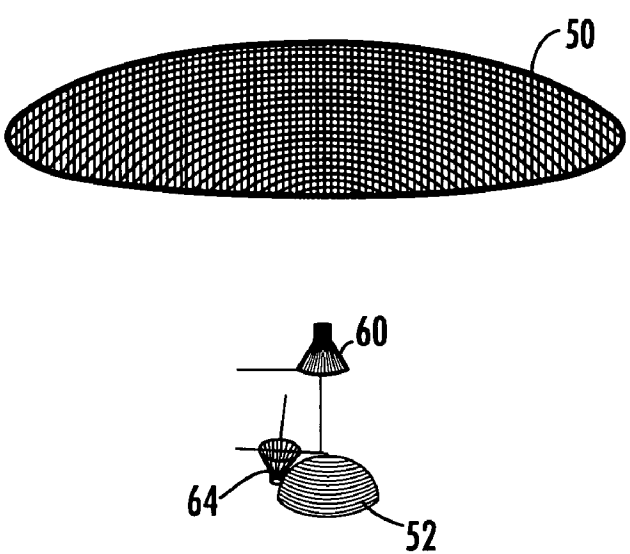
FIG. 7*c* is a top view of FIG. 7*a*.
Figure 7B:
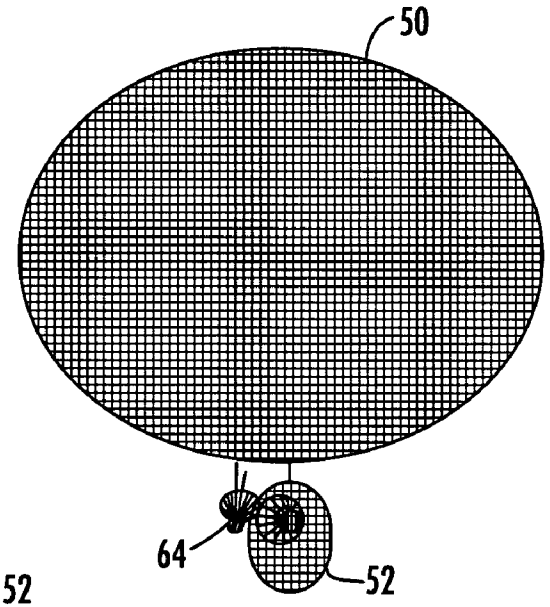
FIG. 7*b* is a front view of FIG. 7*a*.
Figure 7A:
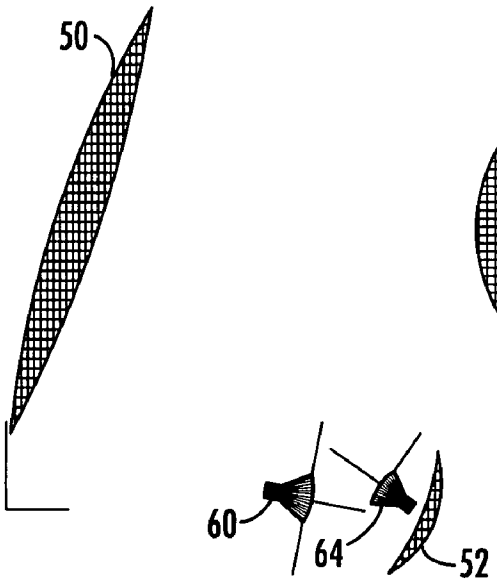
FIG. 7*a* is a schematic side view of an antenna according to the invention with a scanned-beam feed and oval sub reflector.

To avoid degrading performance of the co-located beam associated with the first radio frequency feed 60, addition of a third feed 64 should not block the sub reflector 52. A smaller third feed 64 could be used to minimize blockage, but at the expense of lower directivity for the feed and therefore much higher spillover loss for the scanned beam. The minimum scan angle available to a third feed 64 positioned adjacent the sub reflector 52 may be improved by shaping the sub reflector 52 to have an elevation dimension that is greater than an azimuth dimension, such as an oval shape as shown in FIG. 7. The oval rim sub reflector 52 has a larger dimension in the vertical plane than a circular-rim sub reflector 52 dimensioned for the same minimum scan angle. Similarly, a notched rim may be employed to provide clearance for the third feed 64. Therefore, oval and notched sub reflector 52 rim designs, capture more energy from the feed to reduce sub reflector 52 spillover, improving efficiency relative to a circular rim sub reflector 52 with the same minimum scan angle.

Figures 8A, 8B, 8C:
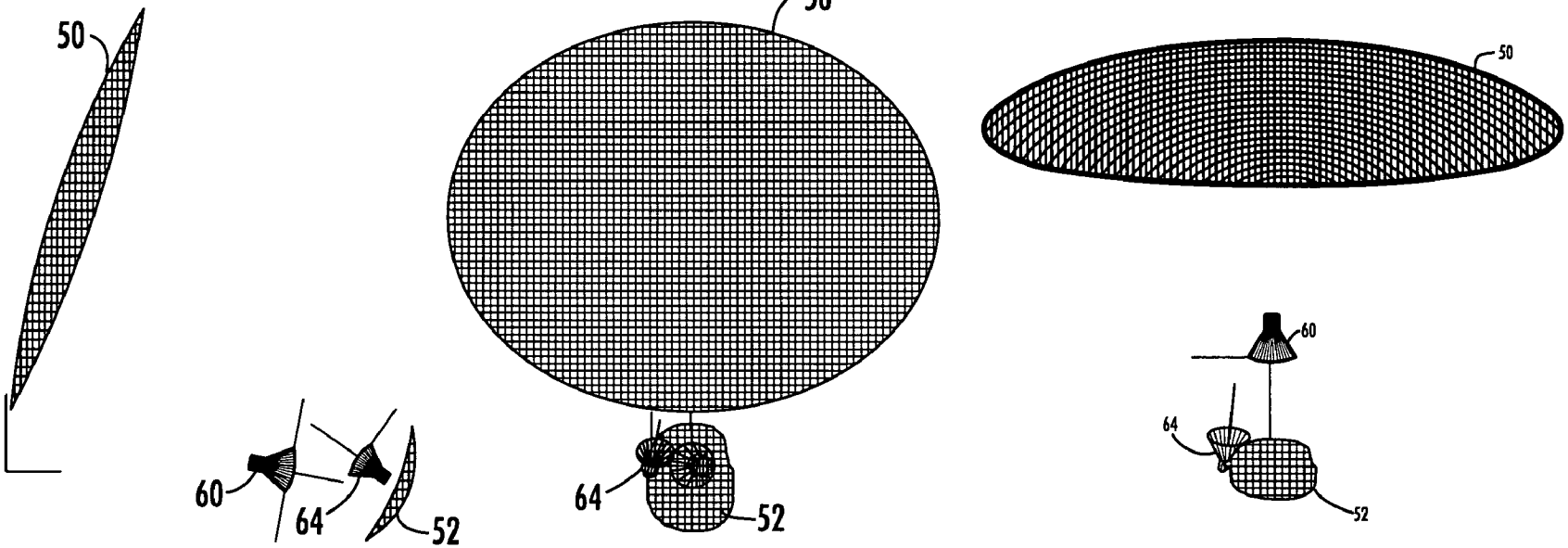
FIG. 8*a* is a schematic side view of an antenna according to the invention with a scanned-beam feed and a distorted oval sub reflector.
FIG. 8*b* is a front view of FIG. 8*a*.
FIG. 8*c* is a top view of FIG. 8*a*.

In another embodiment, the antenna 10 may be improved by further optimizing the oval shape of the sub reflector 52 into a notched and or distorted oval as shown for example in FIG. 8. Thereby, a higher gain feed may now be positioned for the, for example, 5.5° scan position without sub reflector 52 blockage—and without additional spillover loss.

Figure 10:
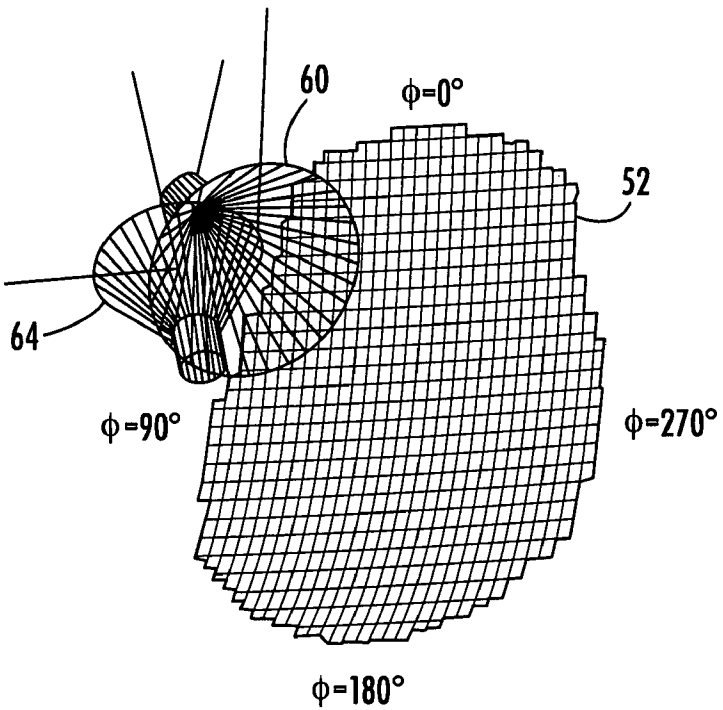
FIG. 10 is a close-up front schematic view of a sub reflector with notched rim according to the numerically tabulated function of FIG. 9 and associated feeds.
Figure 9:
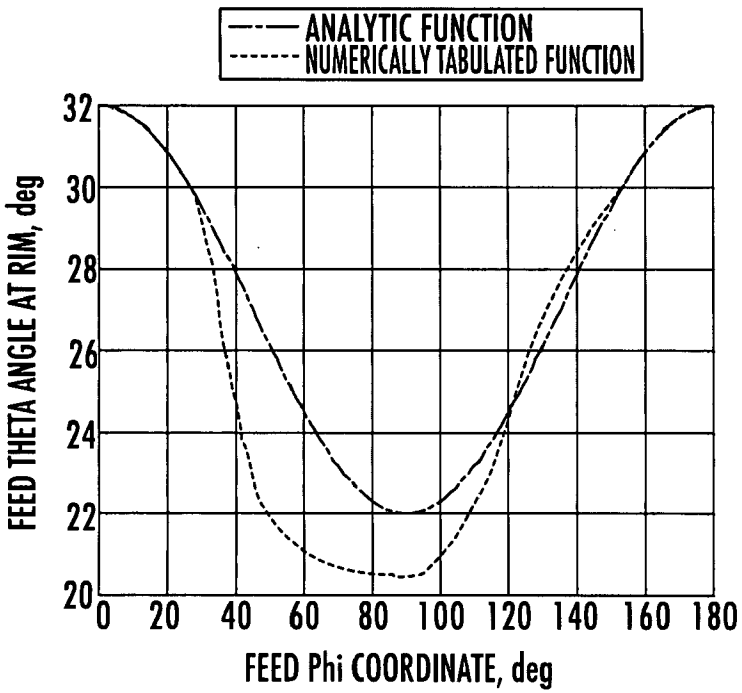
FIG. 9 is a chart identifying analytical and numerically tabulated functions for forming a sub reflector rim with a notched oval rim.

Further, as shown in FIG. 9, the notched and or distorted oval shape may be further optimized via the application of a numerically tabulated sub reflector rim function. This function may specify the feed angle at the sub reflector rim as a function of the feed angle phi in first feed 60 spherical co-ordinates to create a "notch" in the sub reflector, as shown in FIG. 10.

Figure 12A:
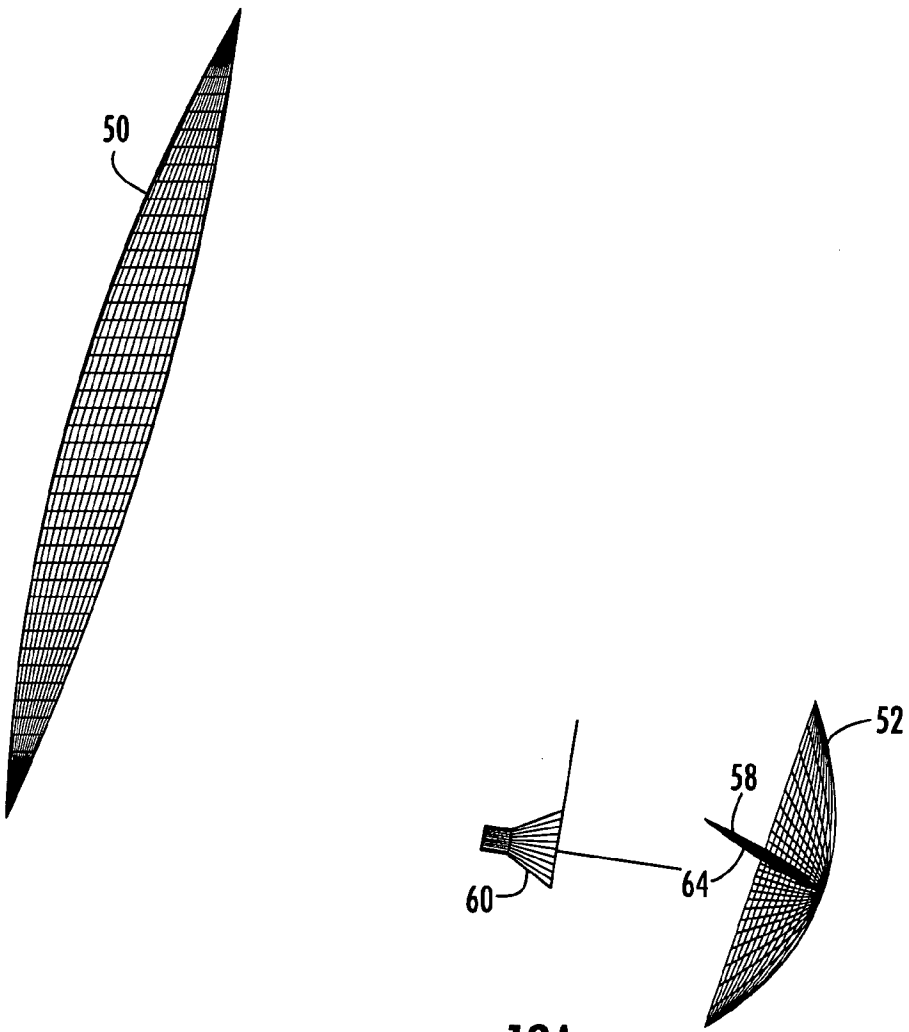
FIG. 12*a* is a schematic side view of an antenna according to the invention with a third feed adjacent to the second feed.
Figure 12B:
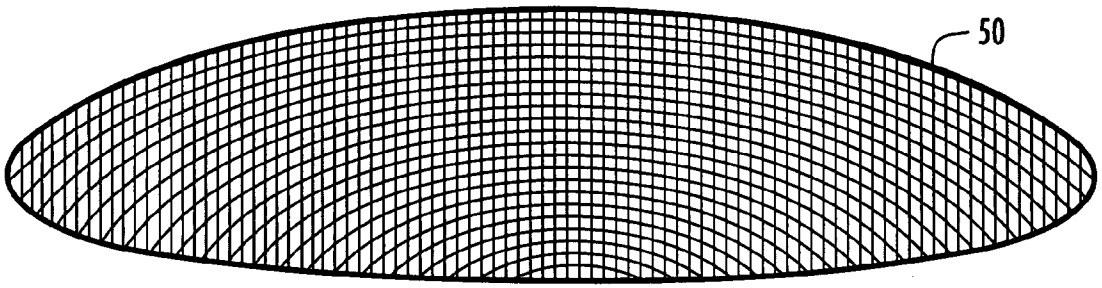
FIG. 12*b* is a schematic top view of FIG. 12*a*.
Figure 12B:
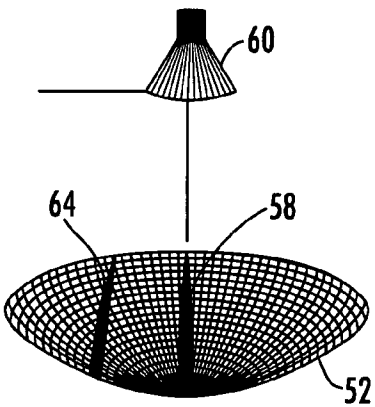

Alternatively, the second feed 58 may be located such that any beam or beams radiated by the second feed 58 are also scanned away from the beam or nominally coincident beams radiated by the first feed 60. Also, as shown in FIGS. 12*a* and 12*b*, a third feed 64 may be placed side by side proximate the second feed 58 position, oriented for scanned feed operation. To assist with scanned feeds of significantly large offsets, the main reflector may be formed with a toroidal or partially toroidal section.

Figure 11:
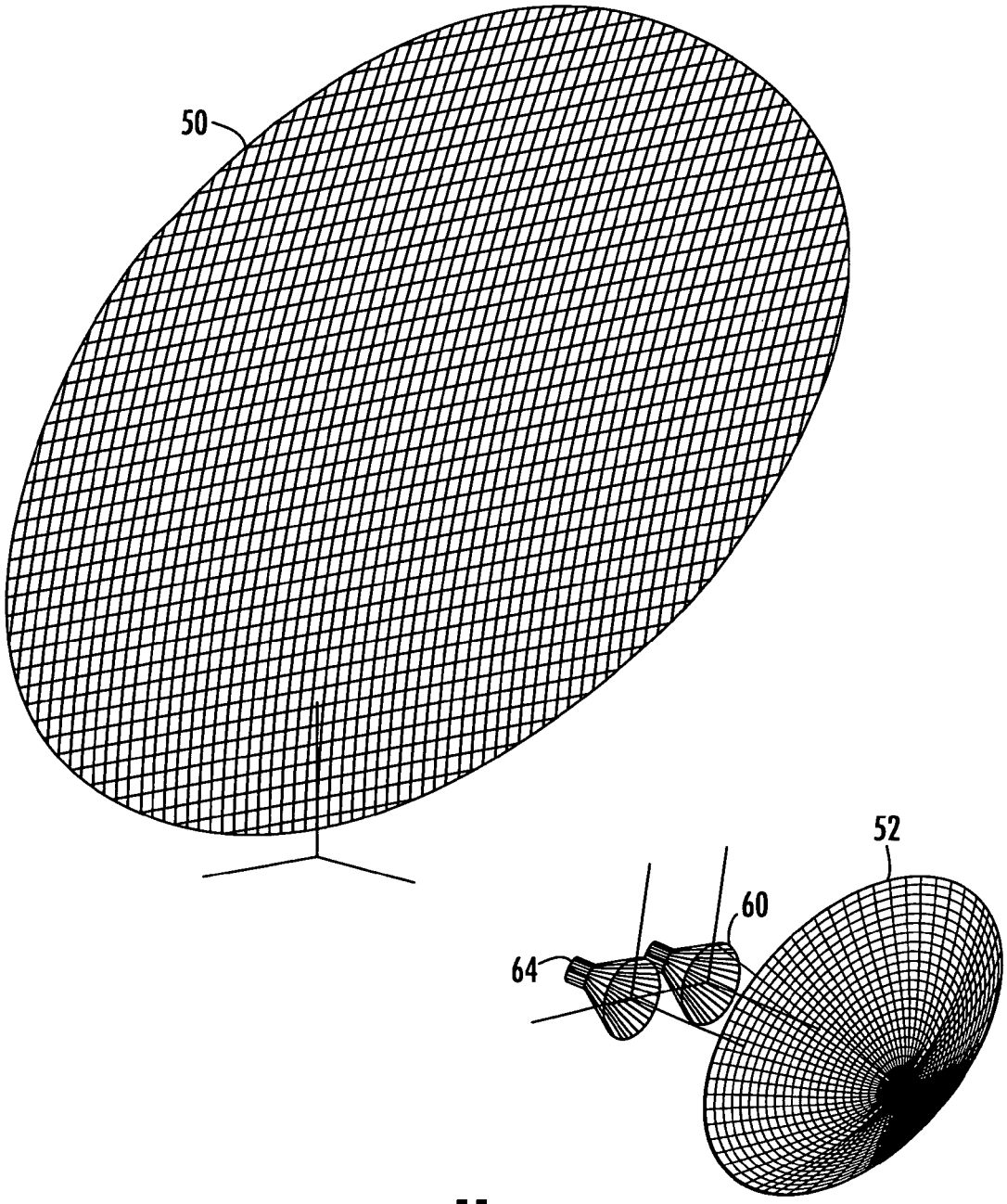
FIG. 11 is an isometric schematic view of an antenna according to the invention with a third feed adjacent to the first feed, according to the invention.

In further embodiments, as shown for example in FIG. 11, the fourth beam may be generated by a third feed 64 that may be located proximate the first feed 60. In this configuration, the third feed 64 may be scanned away from the first feed 60 by between 2 and 8 degrees.

Even if the antenna 10 is initially intended for only nominally coincident beams as described herein above, an oval and or notched shaped sub reflector 52 allows later cost effective addition of third feed 64 upgrades to an installed antenna 10, for example if a satellite TV subscriber later decides they would like to upgrade their channel selection/services.

Multiple third feed(s) 64 could be utilized, mounted at any of the described locations, to produce scanned beams at, for example, +5.5° azimuth scan and at −5.5° azimuth scan away from the three co-located beams. Similarly, multiple fourth feed(s) 64 may be mounted on the same side of the sub reflector 52 to acquire services from satellites stationed at +5° and +90° along the geostationary arc away from the satellite to which the three co-located beams are pointed.

In the present embodiment(s), the invention is demonstrated as a multi-channel satellite communication system in the form of an Internet/Satellite TV system which receives satellite TV in a first frequency band such as the 12 GHz Band (Ku-Band) at the first feed. Outgoing Internet communications are transmitted in a second frequency band such as the 30 GHz Bans and received in a third frequency band such as the 20 GHz Band (KA Band) via the second feed. third feeds, if present, are envisioned as operating in the 12 Ghz Band for reception of additional satellite TV channels/services available on adjacent and or separate satellites. Although the embodiment demonstrated is described with respect to operation in 12, 20 and 30 GHz frequency bands, one skilled in the art will appreciate that the invention may be similarly applied to other frequency bands.

The various embodiments of the invention create a multi-band antenna 10 with improved electrical performance and a compact form, without requiring additional measures such as FSS surfaces on the reflective surface(s) of the sub reflector 52 or the like. From the foregoing, it will be apparent that the present invention brings to the art a multiple band co-located antenna with improved performance that is compact, environmentally durable and has significant manufacturing and installation cost efficiencies.

Table of Parts

| | |
|---|---|
| 10 | antenna |
| 50 | main reflector |
| 52 | sub reflector |
| 58 | second radio frequency feed |
| 59 | waveguide launch |
| 60 | first radio frequency feed |
| 62 | aperture |
| 64 | third feed |
| B | focal region |

Where in the foregoing description reference has been made to ratios integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention.

What is claimed is:

1. A multi-band reflector antenna, comprising:

a main reflector;

a sub reflector;

a first feed; and a second feed projecting from a hole in the sub reflector;

the first feed, the sub reflector and the main reflector positioned in a Gregorian optic configuration wherein an output of the first feed is directed to the sub reflector, from the sub reflector to the main reflector and from the main reflector into a first beam;

the sub reflector shaped to distribute the output of the first feed reflecting off the sub reflector onto the main reflector, whereby a central area of the main reflector has a lower illumination than a surrounding outer area of the main reflector;

the second feed oriented whereby an output of the second feed is directed to the main reflector and from the main reflector into a second beam.

2. The antenna of claim 1, wherein a phase center of the second feed is positioned proximate a focal region of the main reflector.

3. The antenna of claim 1, wherein the second feed is disposed within the hole.

4. The antenna of claim 1, wherein the second feed extends through the hole into a focal region of the main reflector.

5. The antenna of claim 1, wherein the sub reflector is in an offset configuration with respect to the main reflector.

6. The antenna of claim 1, wherein a reflective surface of the sub reflector is not frequency selective.

7. The antenna of claim 1, wherein the second feed is one of a horn antenna, a polyrod antenna, a helix antenna and an antenna array.

8. The antenna of claim 1, further including a primary third feed proximate the sub reflector.

9. The antenna of claim 8, wherein the primary third feed has a minimum scan of greater than 3 degrees.

10. The antenna of claim 8, wherein the primary third feed is positioned within a notch formed in the sub reflector.

11. The antenna of claim 10, wherein the notch is configured via one of a numerically tabulated and an analytic function that varies a rim feed angle of the sub reflector.

12. The antenna of claim 8, further including a secondary third feed adjacent the sub reflector on a side of the sub reflector opposite from the primary third feed.

13. The antenna of claim 8, further including a secondary third feed adjacent the primary third feed.

14. The antenna of claim 1, further including a third feed disposed in a second hole in the sub reflector, adjacent the second feed.

15. The antenna of claim 14, wherein the third feed and the second feed are scanned apart by between 2 and 8 degrees.

16. The antenna of claim 1, wherein the first beam and the second beam are nominally coincident with each other.

17. The antenna of claim 1, wherein the first beam and the second beam are scanned apart by at least 2 degrees.

18. The antenna of claim 1, wherein the second feed has a gain of 14 dBi or less.

19. The antenna of claim 1, wherein the sub reflector is dimensioned to be at least 8 wavelengths of a midband frequency of the first feed.

20. The antenna of claim 1, wherein the second feed is configured to simultaneously operate at two different frequency bands.

21. The antenna of claim 1, further including a third feed disposed proximate the first feed.

22. The antenna of claim 21, wherein the third feed is scanned away from the first feed between 2 and 8 degrees.

23. A multi-band reflector antenna, comprising:

a main reflector;

a sub reflector;

a first feed; and a second feed projecting from a hole in the sub reflector;

the first feed, the sub reflector and the main reflector positioned in a Gregorian optic configuration wherein an output of the first feed is directed to the sub reflector, from the sub reflector to the main reflector and from the main reflector into a first beam;

the second feed oriented whereby an output of the second feed is directed to the main reflector and from the main reflector into a second beam;

the sub reflector shaped to have an elevation dimension that is greater than an azimuth dimension.

24. The antenna of claim 23, wherein the second feed has a gain of more than 14 dBi.

25. The antenna of claim 23, wherein the sub reflector is dimensioned to be less than 8 wavelengths of a midband frequency of the second radio frequency feed.

26. The antenna of claim 23, wherein a phase center of the second feed is positioned proximate a focal region of the main reflector.

27. The antenna of claim 23, wherein the second feed is disposed within the hole.

28. The antenna of claim 23, wherein the second feed extends through the hole into a focal region of the main reflector.

29. The antenna of claim 23, wherein the sub reflector is in an offset configuration with respect to the main reflector.

30. The antenna of claim 23, wherein a reflective surface of the sub reflector is not frequency selective.

31. The antenna of claim 23, wherein the second feed is one of a horn antenna, a polyrod antenna, a helix antenna and an antenna array.

32. The antenna of claim 23, further including a primary third feed proximate the sub reflector.

33. The antenna of claim 32, wherein the primary third feed has a scan of greater than 4 degrees.

34. The antenna of claim 32, wherein the primary third feed is positioned within a notch formed in the sub reflector.

35. The antenna of claim 34, wherein the notch is configured via one of a numerically tabulated and an analytic function that varies a rim feed angle of the sub reflector.

36. The antenna of claim 34, further including a secondary third feed adjacent the sub reflector on a side of the sub reflector opposite from the primary third feed.

37. The antenna of claim 34, further including a secondary third feed adjacent the primary third feed.

38. The antenna of claim 23, further including a third feed disposed in the hole, adjacent the second feed.

39. The antenna of claim 23, wherein the first beam and the second beam are nominally coincident with each other.

40. The antenna of claim 23, wherein the first beam and the second beam are scanned apart by at least 2 degrees.

41. The antenna of claim 23, wherein the second feed is configured to simultaneously operate at two different frequency bands.

* * * * *